US005494244A

United States Patent [19]

Walton

[11] Patent Number: 5,494,244

[45] Date of Patent: Feb. 27, 1996

[54] DEVICE FOR MOUNTING AIR DIFFUSERS AND BOXES TO ROOM PARTITION ORIFICES

[76] Inventor: Edward J. Walton, 1885 Bridgetown Pike, Feasterville, Pa. 19053

[21] Appl. No.: 282,373

[22] Filed: Jul. 29, 1994

[51] Int. Cl.[6] ..... G12B 9/00

[52] U.S. Cl. ..... 248/27.1; 137/360

[58] Field of Search ..... 248/27.1, 27.3, 248/906, 342; 137/360; 454/292

[56] References Cited

U.S. PATENT DOCUMENTS

| | | | |
|---|---|---|---|
| 4,226,393 | 10/1980 | Rardin | 248/27.3 |
| 4,431,151 | 2/1984 | Schonasky | 248/342 X |
| 4,576,349 | 3/1986 | Dearing | 248/906 |
| 4,669,371 | 6/1987 | Sarazen | 248/27.3 |
| 4,688,596 | 8/1987 | Liebmann | 248/27.1 X |
| 5,338,255 | 8/1994 | Akehurst | 454/292 |

FOREIGN PATENT DOCUMENTS

| | | | |
|---|---|---|---|
| 3824301 | 2/1990 | Germany | 248/27.1 |

*Primary Examiner*—J. Franklin Foss

*Attorney, Agent, or Firm*—Joseph W. Molasky & Associates

[57] ABSTRACT

The invention is a bracket having a resilient flange. The bracket attaches to the periphery of a room partition defining an orifice. The bracket provides a secure mounting location for an air diffuser and holds the box associated with the diffuser firmly in place allowing one person to install the diffuser and the box within an orifice.

10 Claims, 3 Drawing Sheets

FIG. 1
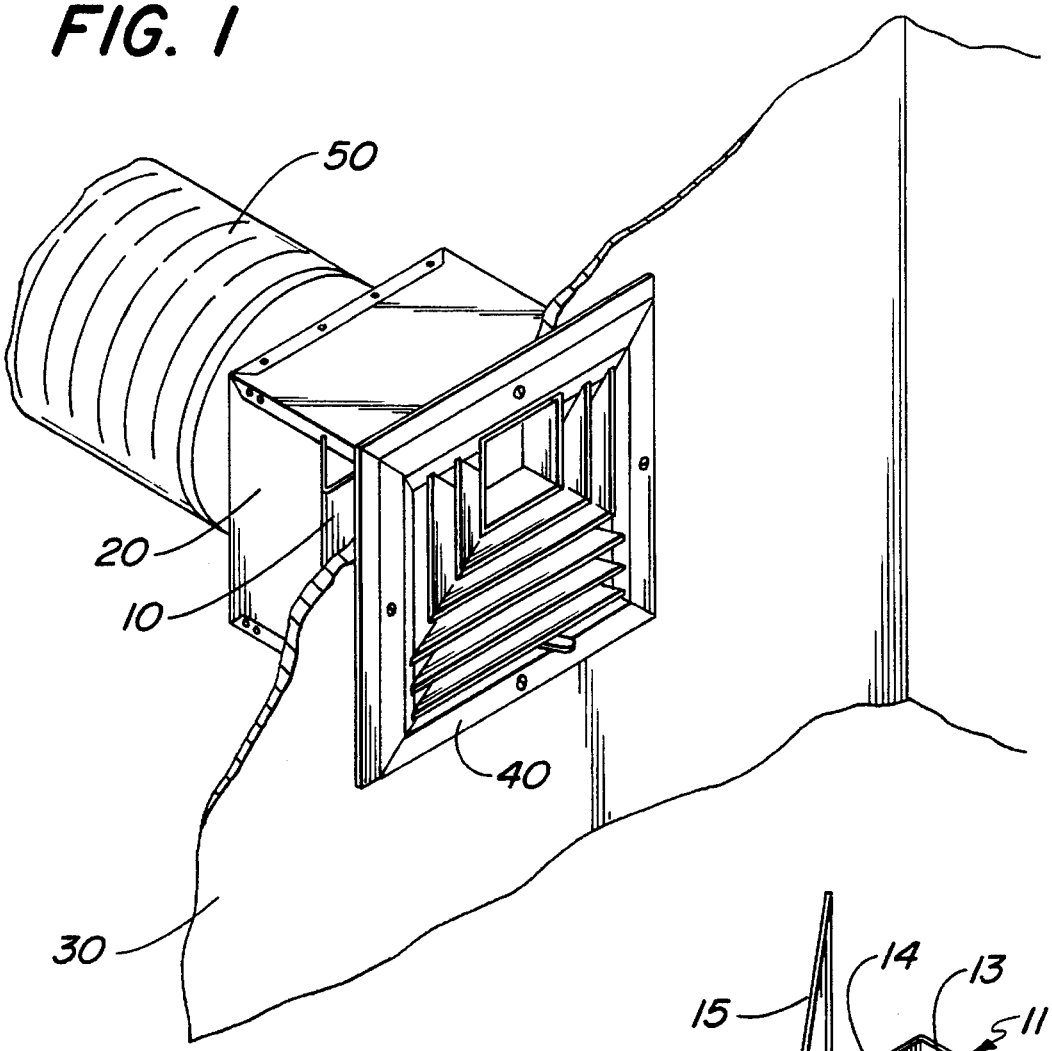
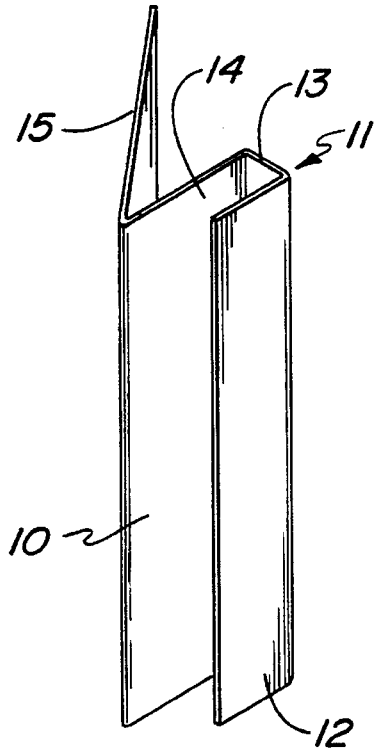
FIG. 2

DEVICE FOR MOUNTING AIR DIFFUSERS AND BOXES TO ROOM PARTITION ORIFICES

BACKGROUND OF THE INVENTION

The present invention relates generally to heating ventilation and air conditioning systems (HVAC); and more particularly, it relates to a device for mounting air diffusers and their matching forced air boxes within orifices in floors, ceilings, and walls.

One of the most common ways to conduct heated or cooled forced air from a furnace or air conditioning unit is by forcing the air through flexible ducts. The terminal ends of the ducts are connected to boxes positioned adjacent orifices in the room partitions leading to the interior of the room to be heated or cooled. The orifices are typically covered by diffusers or grates within the room interior which are attached to both the room partition and to flanges on the boxes.

During installation of a diffuser and its matching box, an installer typically aligns the box with an orifice cut into a partition forming a floor, ceiling, or wall. The box must be held in position on the exterior side of the partition while a second person, positioned on the room side of the partition, drives screws through holes in the diffuser face, through the partition and into flanges on the box. The first person then attaches a flexible duct to the box. This is relatively simple to perform but is very time consuming since two people are needed to perform the installation. In addition, it is common to place HVAC diffusers in ceiling and walls constructed of materials such as drywall, plaster board, and the like. These materials do not accept screws because they are fabricated from calcined compositions which crumble when subjected to a twisting threaded motion as a result of which then form threadless holes or cause the orifice periphery to break away. Thus, screws extending from the diffuser which are driven through a portion of a dry wall partition and into a box flange are only secured to the box flange and are not fixed to the partition. Repeated removal and reattachment of screws driven into the partition periphery, necessitated by cleaning, painting of the room, and the like often result in enlargement of the orifice in the partition and subsequent inability of the user to remount the diffuser and box to the partition.

A need, therefore, exists for a device which holds the box in place so only one person is needed to attach the diffuser to the box and to mount the diffuser and box to the partition orifice.

A need also exists for a device which provides a secure attachment of the diffuser and box to the partition material and which inhibits the partition from crumbling.

SUMMARY OF THE INVENTION

Accordingly, it is an object of the present invention to provide a device which allows one person to install air diffusers and boxes in orifices in room partitions without the assistance of another person. It is also an object of the present invention to provide a secure means of attaching forced air diffuser and register boxes to partitions.

Briefly, these and other objects and aspects of the invention are accomplished by a generally S-shaped device for mounting an air diffuser and a box attachable to said air diffuser in a room partition orifice, said device comprising a generally U-shaped bracket comprised of a.) a first panel; b.) a base plate attached to said first panel, and c.) a second panel attached to said base plate; and a resilient flange attached to said second panel of said generally U-shaped bracket. The bracket is attachable to the periphery of a room partition defining an orifice and is attachable to an air diffuser and the diffuser's matching box.

The device flange permits entry of a box into a partition orifice and hinders withdrawal of the box from the orifice by spring tension between the device flange and the second panel of the bracket caused by the flange being flexed by the box. The device flange also forces the second panel of the device to accept piercing by screws by spring tension between the flange and the second panel of the device caused by insertion of the box into the partition orifice. The device thereby allows one person to mount the diffuser and box to a partition orifice without the assistance of another person.

The generally U-Shaped bracket of the generally S-shaped device also protects the partition periphery from crumbling during insertion and removal of the screws attaching the diffuser to the box, to the partition and to the device, thereby providing a very stable and secure means for mounting the diffuser and box to the partition.

Other objects, features, and advantages of the invention will become more apparent from the following detailed description of the invention when considered in conjunction with the accompanying drawings.

BRIEF DESCRIPTION OF THE DRAWINGS

FIG. 1 is a perspective view of the invention installed in an orifice in a room partition and attached to a diffuser and a box.

FIG. 2 is a perspective view of the invention.

DESCRIPTION OF THE PREFERRED EMBODIMENTS

Figure 3:
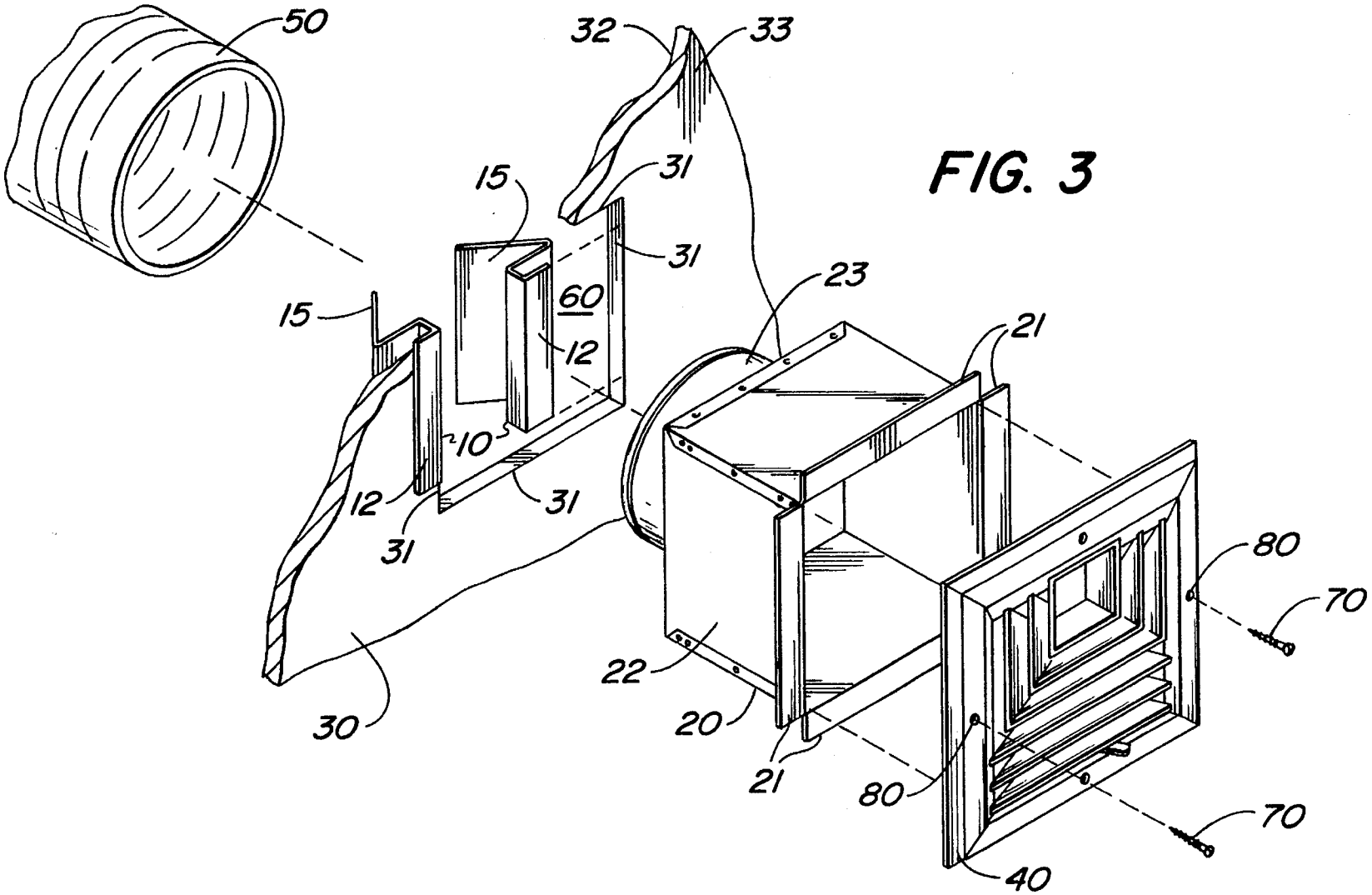
FIG. 3 is an exploded perspective view of the invention as installed in FIG. 1.

Referring now to the drawings wherein like characters designate like or corresponding parts throughout the several views, FIG. 1 illustrates a device 10 attached to a box 20, installed on a room partition 30, and attached to a diffuser 40. Box 20 is attached to flexible duct 50. The word "partition" is defined herein as any construction material such as wallboard, plaster, drywall, or the like which define a wall, or a ceiling.

FIG. 2 illustrates the construction of device 10. Device 10 is comprised of a U-shaped bracket shown generally as 11 and a resilient flange 15. Bracket 11 is comprised of a first panel 12, a base plate 13, and a second panel 14. Second panel 14 and first panel 12 are approximately parallel to each other and approximately perpendicular to base plate 13 giving bracket 11 a generally U-shape and flange 15 forms an acute angle with second panel 14 giving an overall S-shape to device 10.

Figure 4:
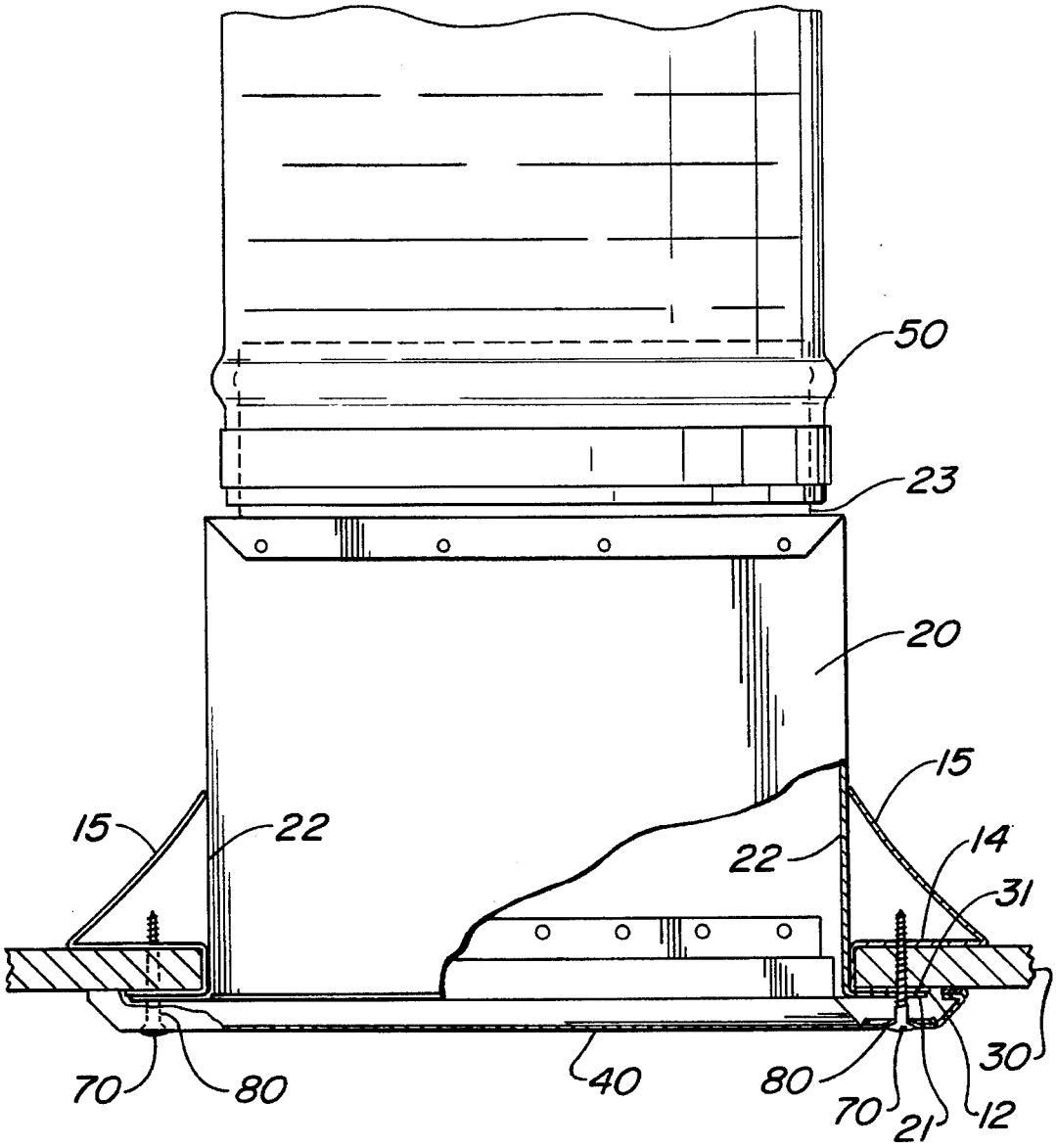
FIG. 4 is a partially cut-away sectional view of the invention.

Device 10 is utilized as shown in FIGS. 1, 3, and 4. With reference to FIG. 3, at least one and preferably two device 10's are attached to sections of a room partition periphery 31 which define an orifice 60 in a room partition 30 forming a part of a ceiling or wall. Two device 10's are shown in FIG. 3; however, more than two device 10's can be utilized as needed depending on the size and shape of the diffuser and box to be mounted. Box 20 is pushed into orifice 60 adjacent the two device 10's until flanges 21 on box 20 contacts periphery 31 of partition 30 and first panels 12 on each device 10, while sides 22 of box 20 contact and flex flanges 15 away from base plate 13 on each device 10. Flanges 15 are resilient and serve two purposes. The flanges 15 allow box 20 to be slid into orifice 60 but hinder the withdrawal of box 20 from orifice 60. Withdrawal of box 20 can be achieved by prying flanges 15 away from sides 22 and pushing box 20 back through orifice 60 in the reverse direction in which box 20 entered orifice 60. Box 20 is thus held within orifice 60 by one or more device 10's without a person on the duct side 32 of partition 30 holding box 20. Flanges 15 also provides a reinforcing pressure in the opposite direction of screw 70 as shown in FIG. 4 due to the box sides 22 flexing flanges 15 away from base plates 13. A lone installer on the room side 33 of partition 30 can thus position diffuser 40 against flanges 21 of box 20 and attach diffuser 40 to box 21 by driving screws through holes 80 in diffuser 40, through flanges 21, first panel 12, partition periphery 31, and through second panel 14 without requiring the assistance of another person to hold box 20 in place.

Device 10 also provides the user with a very secure means to mount the diffuser and box within a partition orifice by providing screw attachment from the diffuser to flanges on the box, and to both first and second panels on the device which brackets the partition periphery 31. This is best shown by FIG. 4. The bracket covers the exterior and room sides of the periphery, thus, inhibiting enlargement of the screw holes through the periphery and thereby inhibiting the periphery 31 from crumbling and enlarging orifice 60. Panels 12 and 14 can have pre-drilled holes to engage screws 70 or the installer can simply create holes in panels 12 and 14 during screw installation. The lone installer can then enter the space on the duct side 32 of partition 30, typically in a basement, crawlspace, attic, or the like and attach duct 50 to duct attachment section 23 on box 20.

The method of attaching a forced air duct to a box, a box to a diffuser, and a diffuser and box to an orifice in a room partition comprises the steps of a.) attaching at least one and preferably at least two generally S-shaped devices each comprising a bracket comprised of a first panel, a base plate attached to the first panel, and a second panel attached to the base plate, and a resilient flange attached to the second panel of the bracket to a the peripheral edge of a room partition defining an orifice; b.) inserting a box into the orifice and adjacent the device or devices of step a.) such that the device or devices hold the box within the orifice; c.) attaching a diffuser to the box, to the device or devices, and to the room partition; and d.) attaching a forced air duct to the box.

Thus, the device allows one person to install forced air ducts to boxes, and boxes to diffusers within orifices in room partitions without the assistance of a second person. The device also provides a very secure means to mount diffusers and boxes to partitions which decreases the danger that the edges of the partition will crumble and enlarge the orifice in the partition.

The device can also be utilized to mount diffusers and boxes to orifices in ceilings, walls, and floors formed by partitions constructed of rigid materials such as wood and cement. Rigid partitions do not require the use of a bracket to prevent enlargement of the partition orifice; however, the device is useful for allowing one person to install the diffusers and boxes to the rigid partitions.

It will be understood, of course, that changes in the details and arrangement of steps and parts which have been described and illustrated herein in order to explain the nature of the invention, may be made by those skilled in the art without departing from the principles and scope of the invention as expressed in the appended claims.

I claim:

1. A generally S-shaped device for mounting an air diffuser and a box attachable to said air diffuser in a room partition orifice, said device comprising;

a generally U-shaped bracket comprised of a.) a first panel;

b.) a base plate attached to said first panel, and c.) a second panel attached to said base plate; and a resilient flange attached to said second panel of said generally U-shaped bracket;

said bracket attachable to the periphery of a room partition defining an orifice;

and said bracket attachable to an air diffuser and a box.

2. The device of claim 1 wherein said flange forms an acute angle with said second panel.

3. The device of claim 2 wherein said first panel and said second panel are approximately parallel to each other and both said first and second panels are approximately perpendicular to said base.

4. The device of claim 3 wherein said flange permits entry of said box into said orifice and hinders withdrawal of said box from said orifice.

5. The device of claim 4 wherein said bracket is attached to said partition by screws piercing said first and second panels of said bracket and said screws piercing said partition.

6. The device of claim 5 wherein said flange hinders withdrawal of said box by spring tension between said flange and said second panel of said bracket, said spring tension caused by said flange being flexed by said box.

7. The device of claim 6 wherein said flange forces said second panel to accept piercing by said screws by spring tension between said flange and said second panel of said bracket, said spring tension caused by said flange being flexed by said box.

8. The device of claim 7 wherein said device allows one person to mount said diffuser and said box within said orifice.

9. The device of claim 8 wherein said partition periphery is protected from crumbling during insertion and removal of said screws by said generally U-shaped bracket of said generally S-shaped device.

10. A method for attaching a forced air duct to a box, a box to a diffuser, and a diffuser and a box to an orifice in a room partition comprising the steps of:

a.) attaching at least one generally S-shaped device comprising a generally U-shaped bracket comprised of a first panel, a base plate attached to said first panel, and a second panel attached to said base plate, and a resilient flange attached to said second panel of said generally U-shaped bracket to a portion of said partition peripheral edge defining an orifice;

b.) inserting a box into said orifice and adjacent said generally S-shaped device of step a.) such that said generally S-shaped device holds said box within said orifice;

c.) attaching a diffuser to said box, to said first and second panels of said device and to said partition; and d.) attaching a forced air duct to said box.

* * * * *